US006418590B1

(12) United States Patent
Nipper et al.

(10) Patent No.: US 6,418,590 B1
(45) Date of Patent: Jul. 16, 2002

(54) BIFOLD DOOR FITTING

(76) Inventors: Juanda J. Nipper; Stephanie A. Stafford, both of 4630 Von Talge Meadows Dr., St. Louis, MO (US) 63128

( * ) Notice: Subject to any disclaimer, the term of this patent is extended or adjusted under 35 U.S.C. 154(b) by 31 days.

(21) Appl. No.: 09/609,794

(22) Filed: Jul. 3, 2000

(51) Int. Cl.[7] ..... E05D 5/00

(52) U.S. Cl. ..... 16/382; 16/386; 16/229; 248/220.1

(58) Field of Search ..... 16/382, 386, 389, 16/229; 248/220.1, 300; 403/3, 4; 160/199, 206, 210, 213

(56) References Cited

U.S. PATENT DOCUMENTS

| | | | | | |
|---|---|---|---|---|---|
| 2,028,918 | A | | 1/1936 | Panza | 126/202 |
| 2,911,176 | A | * | 11/1959 | Roediger et al. | 248/220.1 |
| 3,049,327 | A | * | 8/1962 | Caudell | 248/220.1 |
| 3,221,804 | A | * | 12/1965 | Rudnick | 16/229 |
| 3,285,324 | A | * | 11/1966 | Stein et al. | 16/229 |
| 3,389,503 | A | * | 6/1968 | Goess et al. | 16/389 |
| 3,511,300 | A | * | 5/1970 | Matyas | 16/229 |
| 3,648,755 | A | | 3/1972 | Thiele | 160/201 |
| 3,683,453 | A | * | 8/1972 | McLeland et al. | 16/388 |
| 3,813,730 | A | * | 6/1974 | Smith | 16/382 |
| 4,167,261 | A | * | 9/1979 | Bartels | 248/220.1 |
| 4,416,087 | A | | 11/1983 | Ghatak | 49/462 |
| 4,825,509 | A | | 5/1989 | Mitchell et al. | 16/382 |
| 5,056,193 | A | * | 10/1991 | Colamussi | 16/381 |
| 5,076,626 | A | | 12/1991 | Tiddy et al. | 292/337 |
| 5,240,216 | A | | 8/1993 | Lin et al. | 248/300 |
| 5,312,078 | A | * | 5/1994 | Marsh | 248/220.1 |
| 5,353,473 | A | * | 10/1994 | Sherick | 16/97 |
| 5,490,305 | A | * | 2/1996 | Domingo Ribot | 16/229 |
| 5,553,352 | A | | 9/1996 | Bolton | 16/229 |
| 5,566,509 | A | | 10/1996 | Long | 49/462 |
| 5,918,660 | A | | 7/1999 | Crawford, III | 160/201 |

* cited by examiner

*Primary Examiner*—Chuck Y. Mah
(74) *Attorney, Agent, or Firm*—Grace J. Fishel

(57) ABSTRACT

A fitting and method for repairing and reinforcing a bifold door panel such the door retains a pivot pin. The fitting is L-shaped with two legs, each of which has a flange along one side edge. Openings are provided in the legs for registry with a pivot hole in the door panel. Other openings are provided in the legs and flanges for a plurality of screws for mounting the fitting to the door panel. The pivot pin is housed in a sleeve with a flange which abuts an outer surface of the leg when the pin is received in the opening in registry with the pivot hole, for holding the pivot pin upright in the pivot hole.

8 Claims, 3 Drawing Sheets

BIFOLD DOOR FITTING

BACKGROUND OF THE INVENTION

1. Field of the Invention

The present invention relates to a fitting for repairing and reinforcing a bifold door panel such that the door retains a pivot pin.

2. Brief Description of the Prior Art

Bifold doors are commonly used for closets and the like. They are favored by builders but they are a bane to property managers because they are expensive to maintain.

In a typical bifold door installation, four door panels are used, two of which are hinged together at each side of a door frame. In a smaller opening, only two door panels are used. The panel nearer the jamb, known as the pivot door, is mounted on pivots at the top and bottom and supports the full weight of both doors. The other panel further from the side of the opening, known as the lead door, typically has a pivot pin with a guide that runs in a guide track provided at the top of the opening.

When the doors are closed, the panels are in the plane of the frame. The doors are opened by pulling on the lead door, causing the doors to fold relative to each other. As the doors open, the pivot door pivots adjacent the jamb and the hinged edge of the lead door swings outwardly as constrained by the hinges between the doors and the guide in the tracks.

The guide track used with bifold doors typically is an elongated U-shaped channel having an elongated projection or ledge extending inwardly from each side of the track. A pivot bracket for the top pivot on the pivot door is seated on or against the pair of ledges and is securely fastened to the track with a screw or similar fastener.

When bifold doors are slammed open, as commonly happens in service, particularly in rental units, the pivot pin on the lead door strikes the pivot bracket of the pivot door with considerable force. Since the pivot bracket is tightened on the track, it does not move. If the bifold door is slammed open hard enough, or a sufficient number of times, the hole for the pivot pin in the lead door will become oversized, causing the pin to tilt and the guide to pop out of the track rendering the door inoperative. Sometimes the force is sufficient such that the wood around the pivot hole is split out.

There are currently only two possible repairs for this type of damage. The door can be removed from the track and a new piece of framing installed where the wood around the hole is enlarged or split. Many bifold panels are constructed with a frame consisting of a pair of vertical stiles connected with top and bottom rails. A particle board or plywood sheet is glued front and back to the wood frame. To make a repair on this kind of door panel, the covering sheets must be removed and the broken section of the frame, usually the stile, replaced. Once this has been completed, the covering sheets are reglued to the frame and a new hole drilled for the pivot pin. With a rental unit, this repair is usually made off-site and takes approximate twenty-four (24) hours to complete, taking into consideration the drying time of the glue. The other option is to replace the bifold door with a new door.

Occasionally, the pivot pins at the top or bottom of the pivot door are also damaged. This can occur when the closet is overfilled and a user forces the door closed. As force is applied to the hinged edge and the door straightens, it functions as a toggle joint putting tremendous pressure on the pivots. Since the top and bottom pivots on the pivot door are fixed, the only give is in the wood around the pivot hole, which becomes oversized or is broken out. If one of the pivot pins on the jamb side of the frame comes out of its mounting bracket, the door becomes inoperative. The repair options for the pivot panel are the same as for the lead panel, either carpentry or replacement, both of which are expensive. Besides, unless the user gives the repaired or new door better treatment, damage is likely to recur.

BRIEF SUMMARY OF THE INVENTION

In view of the above, it is an object of the present invention to provide a fitting for right-hand or left-hand use in repairing or reinforcing a pivot hole in a bifold door panel. It is another object to provide a fitting that can be used at minimal cost in materials and labor. It is also an object to provide a fitting that can be installed on-site. Other objects and features of the invention will be in part apparent and in part pointed out hereinafter.

A fitting for repair and reinforcement of a bifold door panel such that the door retains a pivot pin is L-shaped in transverse cross-section with two legs. Each of the legs has a flange along one side edge. The legs have an inside surface with a width sized to receive a portion of a standard width thickness of the bifold panel and the flanges have an inside surface with a width sized to receive a portion of an inside face of the bifold panel. Each of the legs has an opening for receiving and retaining a pivot pin and some or all of said legs and said flanges have an opening for receiving and retaining a screw for attaching the fitting to a corner of a panel with a pivot hole in need of repair or reinforcement.

In use for right-hand or left-hand installation, a fitting as described above is selected and the pivot pin is removed from the pivot hole adjacent the corner of the panel to be repaired or reinforced. The fitting is mounted over the corner with the opening in the leg for the pivot pin in registry with the pivot hole. The fitting is then secured to the panel with a plurality of screws, each of said screws extending through one of the openings in the legs and flanges for screws and into the panel thereby securely mounting the fitting on said door panel. The pivot pin is inserted through the opening in the leg in registry with the pivot hole and into the pivot hole. When the pivot pin is in a sleeve with a flange, the sleeve of the pivot pin in inserted through the opening in the leg in registry with the pivot hole until the flange makes contact with an outer surface of the leg. The pivot pin is thereby maintained in upright position in the pivot hole, ensuring proper mounting of the bifold door in the door frame.

The invention summarized above comprises the constructions and methods hereinafter described, the scope of the invention being indicated by the subjoined claims.

BRIEF DESCRIPTION OF THE SEVERAL VIEWS OF THE DRAWING

In the accompanying drawings, in which one of various possible embodiments of the invention is illustrated, corresponding reference characters refer to corresponding parts throughout the several views of the drawings in which.

DETAILED DESCRIPTION OF THE INVENTION

Figure 1:
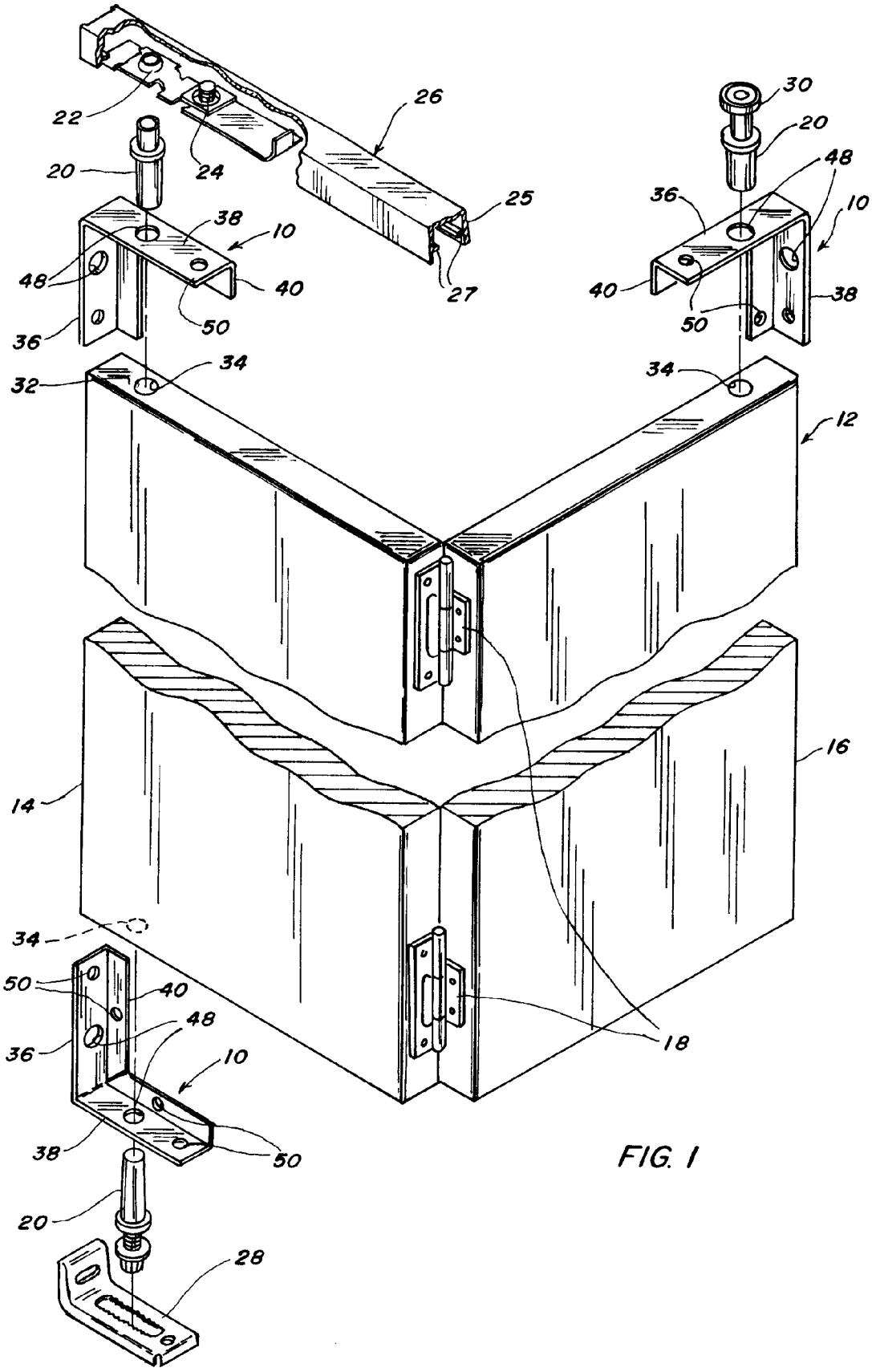
FIG. 1 is an exploded perspective view of three fittings for repairing and reinforcing a bifold door shown in connection with a top and bottom pivot pin on the pivot panel and a top pivot on the lead panel, said panels hinged together and mounted in an opening with an overhead track.

Referring to the drawings more particularly by reference character, reference numeral 10 refers to a fitting for use in reinforcing a bifold door panel in accordance with the present invention. As shown in FIG. 1, a typical bifold door 12 has a pivot panel 14 and a lead panel 16 which are hinged together at 18. Pivot panel 14 has a pivot pin 20 at the top and at the bottom. Top pivot pin 20 is received in a bracket 22 which is attached with a machine screw 24 to a track 26 mounted along the top of a door opening. Track 26 is a U-shaped channel 25 with an elongated projection 27 extending inwardly from each side of channel 25. Bottom pivot pin 20 is received in a bracket 28 which, as illustrated, is attached to the floor. Top pivot pin 20 may be spring biased to assist in installation and removal of the door from the opening and bottom pivot pin 20 may be threadedly, vertically adjustable. It will be understood that the present invention is not limited to the particular pivot pins and brackets shown. In some instances, for example, bottom pivot 20 may be attached to a track (not shown) mounted along the bottom of the door opening. In other instances, bottom pivot pin 20 may be spring loaded and top pivot pin 20 vertically adjustable. Lead panel 16 has top pivot pin 20 attached to a guide roller 30 received in track 26. Top pivot pin 20 on lead panel 16 may be spring biased, adjustable or not. When a track is provided along the bottom of the door opening, lead panel 16 may be provided with a second guide (not shown) at the bottom of the panel.

Figure 3:
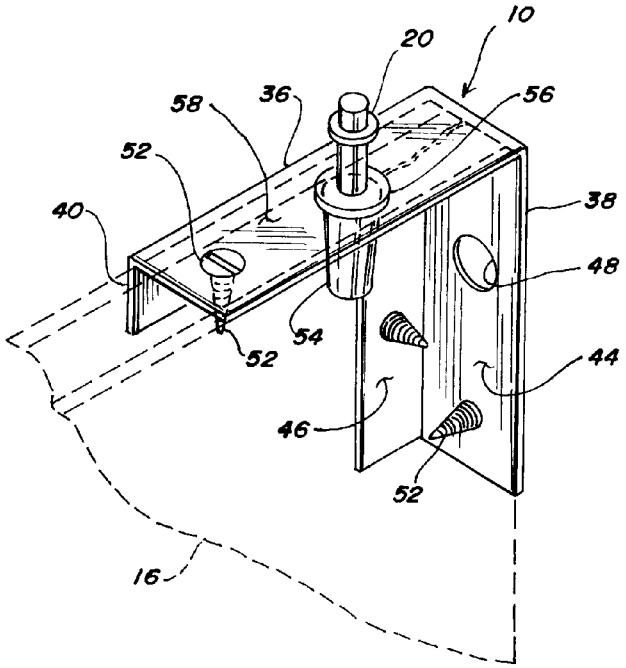
FIG. 3 is a perspective of the damaged corner shown repaired with the fitting.
Figure 5:
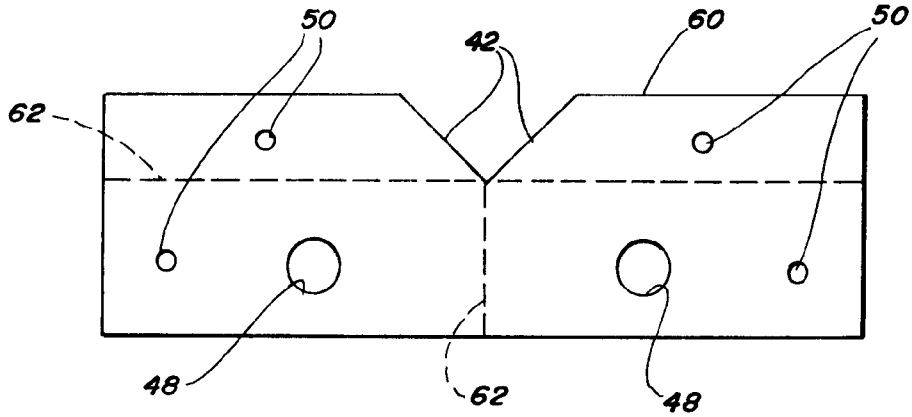
FIG. 5 is a plan view of a blank from which the fitting may be formed.

Fitting 10 is adapted for right-hand or left-hand installation on a corner 32 of pivot panel 14 or lead panel 16 with a hole 34 in an edge of the panel near corner 32 for pivot pin 20. Fitting 10 is L-shaped in transverse cross-section with two legs 36, 38. Legs 36, 38 are preferably of equal length, each of which has a flange 40 along one side edge. Meeting edges 42 of flanges 40 are mitered as shown in FIG. 5. Legs 36, 38 and flanges 40 form a box-like form, with legs 36, 38 at right angles to each other, and flanges 40 at right angles to legs 36, 38, for embracing corner 32 as shown in FIG. 3 and as more particularly described below.

Legs 36, 38 have an inside surface 44 with a width sized to received a portion of a standard width thickness of bifold panel 14 or 16 and flanges 40 have an inside surface 46 with a width sized to receive a portion of an inside face of the bifold panel such that fitting 10 is not noticeable when the door is viewed from the user side. Each of legs 36, 38 has a opening 48 for receiving and retaining pivot pin 20 and each of legs 36, 38 and flanges 40 has an opening 50 for receiving and retaining a wood screw 52 for attaching fitting 10 over corner 32. It will be understood that there may be more than one opening 50 in each of legs 36, 38 and flanges or that, in some instances, openings may be omitted from some of the members.

Bifold panels are typically predrilled with pivot hole 34 about 1-1/16 inch from corner 32 in a top or bottom edge of pivot panel 14 or lead panel 16. There will be some variance of course in this distance, depending on the manufacturer or on the nature and condition of the wood. Opening 48 in each of legs 36, 38 is spaced about 1-1/16 inch from the bend so that opening 48 will be in registry with pivot hole 34 when fitting 10 is installed over corner 32. Many popular pivot pins 20 have a shaft diameter of either 3/8 inch or 7/16 inch and are housed in a sleeve 54 with a flange 56 at its upper end. Opening 48 in each of legs 36, 38 is sized to snugly receive sleeve 54. Insertion of pivot pin 20 in sleeve 54 is stopped when an underside of flange 56 makes contact with an outer surface 58 of legs 36, 38 and pivot pin 20 is seated in opening 48.

As shown in FIG. 5, fitting 10 is of unitary construction and formed from a sheet of metal which is cut to shape and drilled with openings 48 and 50 to form a blank 60. Blank 60 is bent along score lines 62 to form legs 36, 38 and flanges 40. It will be understood that fitting 10 may be of non-unitary construction or formed by other manufacturing procedures and of other suitable materials such as plastic or the like. Fitting 10 is preferably designed so that it is suitable for use with substantially all standard sized bifold door panels, typically 1-3/8, 1-3/4 or 2 inches thick. For this purpose, legs 36, 38 are about 3-1/2 inches long and 1-1/4 inches wide with flanges 40 of the same length and about 3/4 inch wide. Fitting 10 may be used "as is" or may be primed, painted or otherwise finished to meet aesthetic requirements. When openings 48, 50 are formed as shown, fitting 10 may be used for a right-hand or left-hand installation, top or bottom. This is a major advantage as the manufacturer and user does not need to inventory different, right-hand or left-hand fittings.

Figure 2:
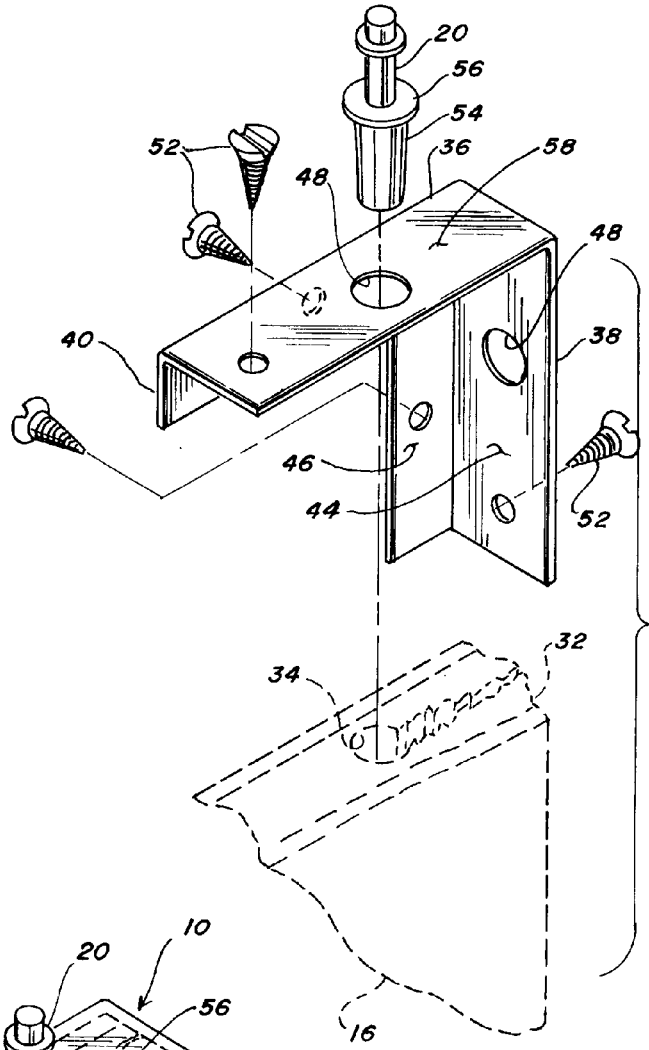
FIG. 2 is an exploded perspective view of a fitting and a corner of a panel which has been damaged.
Figure 4:
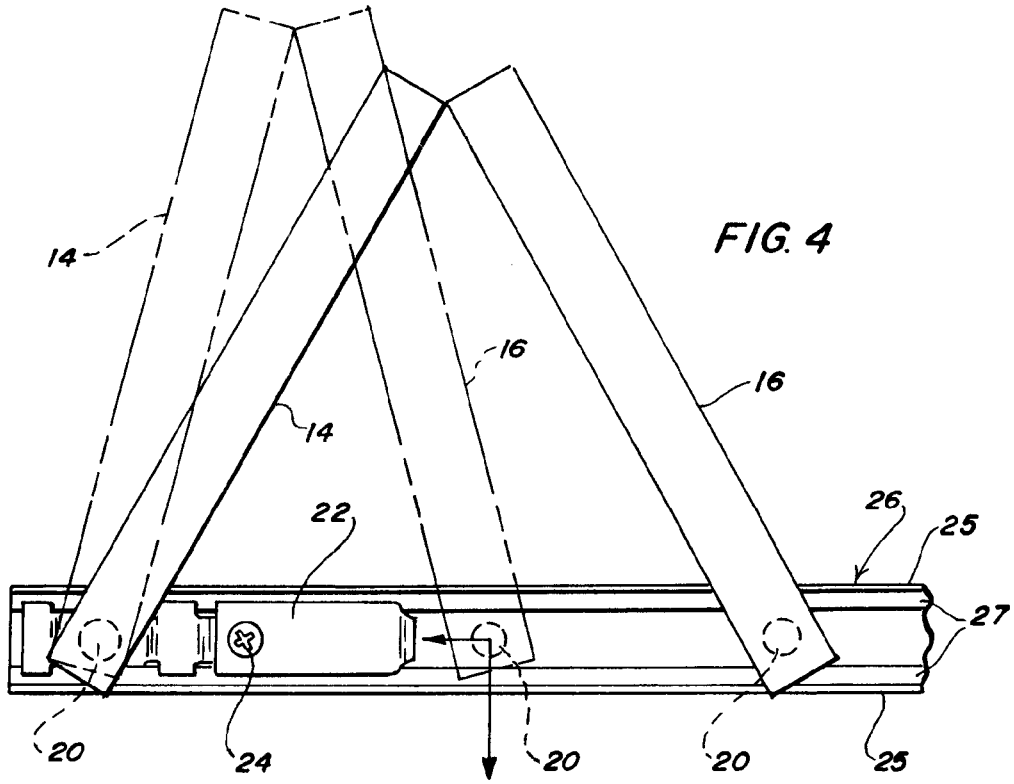
FIG. 4 is a bottom view of the pivot and lead panels and the track.

Turning to FIG. 4, in combination with FIG. 1, it is seen that bracket 22 provides a pivot point for top pivot pin 20 on pivot panel 14 and is fixed to track 26 with machine screw 24. When bifold door 12 is opened, pivot pin 20 in lead panel 16 strikes against bracket 22 in track 26, applying a longitudinally directed force and a laterally directed force to this pivot pin 20. These forces combine to enlarge pivot hole 34 in lead panel 16, causing pivot pin 20 to tilt and guide roller 30 to pop out of track 26, rendering bifold door 12 inoperative. In some instances, as shown in FIG. 2, the force on pivot pin 20 may be sufficient for it to break away a portion of the stile in which pivot hole 34 is drilled. Under severe enough treatment, lead panel 16 may split as shown in FIG. 2. Similar damage to pivot pins 20 in the top and bottom of pivot panel 14 may be done if the closet is overfilled. In which case, as bifold door 12 is forced closed, it acts as a toggle joint, applying force on the top and bottom pivot pins 20 of the pivot panel, which are fixed in brackets 22 and 28, respectively.

Fitting 10 can be used for repairing or protecting a bifold panel from damage as described above, at minimal cost in materials and labor. In use as shown in FIGS. 2 and 3, pivot pin 20 is removed from pivot hole 34 and fitting 10 is applied to a damaged corner 32 of pivot panel 14 or lead panel 16 such that flanges 40 are on the backside of the panel, opposite the user. With opening 48 in registry with pivot hole 34, leg 38 pushes the wood broken out of the panel back into place, or bridges over the hole, as wood screws 52 tighten fitting 10 into place. When sleeve 54 is then inserted through opening 48 into pivot hole 34, flange 56 on sleeve 54 holds pivot pin 20 in upright position even though the pivot hole may be oversized. Lead panel 16 or pivot panel 14 is then reconnected to track 26. In the case of top pivot pin 20, lead panel 16 or pivot panel 14 can be repaired or protected without taking bifold door 12 down. Installation of fitting 10 on bottom pivot pin 20 does require unhanging the door but fitting 10 can be attached without taking the door off-site for repair.

In view of the above, it will be seen that the several objects of the invention are achieved and other advantageous results attained. As various changes could be made in the above constructions and methods without departing from the scope of the invention, it is intended that all matter contained in the above description or shown in the accompanying drawings shall be interpreted as illustrative and not in a limiting sense.

What is claimed:

1. A bifold door panel repair and reinforcement fitting for right-hand or left-hand installation on a door panel with a hole adapted to receive a pivot pin in an edge adjacent a corner, said fitting having an L-shaped transverse cross-section with two legs, each of said legs having a flange along one side edge, said legs having an inside surface with a width sized to receive a portion of a standard width thickness of the bifold panel, said flanges having an inside surface with a width sized to receive a portion of an inside face of the bifold panel, each of said legs having an opening adapted to receive and retain a pivot pin, some or all of said legs and said flanges having an opening adapted to receive and retain a screw for attaching the fitting to the corner whereby the fitting embraces the corner when installed with the screws and one of said openings in registry with the hole for the pivot pin holds the pivot pin in upright position.

2. The fitting of claim 1 wherein the opening in the leg in registry with the pivot hole is sized for snug receipt of a pivot pin in a sleeve with a flange such that the sleeve with the flange is in contact with an outer surface of the leg for upright support of the pivot pin in the pivot hole.

3. The fitting of claim 1 wherein the flanges meet at a mitered edge.

4. The fitting of claim 3 wherein the legs are about 1-¼ inches wide and the flanges are about ¾ inch wide.

5. The fitting of claim 4 wherein the legs and the flanges are each about 3-½ inches long.

6. A method for repairing and reinforcing a bifold door panel, said method comprising the steps of:

providing a fitting for right-hand or left-hand installation on a door panel having a hole for a pivot pin in an edge of the door panel adjacent a corner, said fitting having an L-shaped transverse cross-section with two legs, each of said legs having a flange along one side edge, said legs having an inside surface with a width sized to receive a portion of a standard width thickness of the bifold panel, said flanges having an inside surface with a width sized to receive a portion of an inside face of the bifold panel, each of said legs having an opening for receiving and retaining a pivot pin, some or all of said legs and said flanges having an opening for receiving and retaining a screw for attaching the fitting to the corner;

removing the pivot pin from the pivot hole adjacent the corner of the panel to be repaired or reinforced;

mounting said fitting over the corner with the opening in the leg for the pivot pin in registry with the pivot hole;

securing said fitting to the panel with a plurality of screws, each of said screws extending through one of the openings in the legs and flanges for screws and into the panel thereby securely mounting the fitting on said door panel.

7. The method of claim 6 further comprising inserting the pivot pin through the opening in the leg in registry with the pivot hole and into the pivot hole.

8. The method of claim 7 wherein the pivot pin is in a sleeve with a flange and wherein the sleeve of the pivot pin in inserted through the opening in the leg in registry with the pivot hole until the flange makes contact with an outer surface of the leg thereby maintaining the pivot pin in upright position in the pivot hole.

* * * * *